US005778560A

United States Patent [19]

Danieli

[11] Patent Number: 5,778,560

[45] Date of Patent: Jul. 14, 1998

[54] STABLIZING SUPPORT, PARTICULARLY FOR CONTROLLING PRONATION IN SPORTS SHOES

[75] Inventor: Diego Danieli, Caerano San Marco, Italy

[73] Assignee: Diadora S.p.A., Caerano San Marco, Italy

[21] Appl. No.: 748,923

[22] Filed: Nov. 14, 1996

[30] Foreign Application Priority Data

Nov. 15, 1995 [IT] Italy ..... PD95A0217

[51] Int. Cl.[6] ..... A43B 13/18; A43B 7/24; A43B 21/32

[52] U.S. Cl. ..... 36/35 R; 36/28; 36/143; 36/144

[58] Field of Search ..... 36/28, 27, 25 R, 36/142, 143, 144, 37, 35 R

[56] References Cited

U.S. PATENT DOCUMENTS

| | | | |
|---|---|---|---|
| 4,262,433 | 4/1981 | Hagg et al. | 36/35 R |
| 4,535,553 | 8/1985 | Derderian et al. | 36/28 |
| 4,573,279 | 3/1986 | Feurer-Zogel et al. | 36/35 R |
| 4,815,221 | 3/1989 | Diaz | 36/28 |
| 4,843,737 | 7/1989 | Vorderer | 36/27 |
| 4,972,611 | 11/1990 | Swartz et al. | 36/28 |
| 5,224,278 | 7/1993 | Jeon | 36/27 |
| 5,282,325 | 2/1994 | Beyl | 36/27 |
| 5,544,431 | 8/1996 | Dixon | 36/27 |

FOREIGN PATENT DOCUMENTS

| | | | |
|---|---|---|---|
| 394119 | 10/1990 | European Pat. Off. | 36/25 R |
| 2407684 | 7/1979 | France | 36/37 |
| 2487646 | 2/1982 | France | 36/25 R |

*Primary Examiner*—Paul T. Sewell
*Assistant Examiner*—Anthony Stashick
*Attorney, Agent, or Firm*—Guido Modiano; Albert Josif

[57] ABSTRACT

A stabilizing support, particularly for controlling pronation in sports shoes, including a first bridge-like component, to be included in the sole of the shoe at the outer and/or inner part of the heel and accommodating at least one second detachable stiffening component, which is adapted to vary the flexing condition of the first component.

20 Claims, 3 Drawing Sheets

STABLIZING SUPPORT, PARTICULARLY FOR CONTROLLING PRONATION IN SPORTS SHOES

BACKGROUND OF THE INVENTION

The present invention relates to a stabilizing support particularly but not exclusively useful for controlling pronation in sports shoes.

It is known that shoes in general and sports shoes in particular must facilitate postural stability of the wearer both in static and in dynamic conditions.

In particular, in a sports context stability must be ensured even in conditions that produce intense stresses, sometimes of the momentary type.

Another important feature of shoes in general and of sports shoes in particular relates to efficiency in transferring the energy of the athlete to the ground.

This feature, together with the static and dynamic stability characteristics, are to a large extent determined by the sole.

In particular, adapted flexing, and therefore adapted structural rigidity, in every point of the sole of the foot is fundamental and must be ensured in any operating condition.

Many devices for conditioning the flexing of the sole in preset points have been devised in order to obtain shoes that provide ever-increasing stability and postural control as well as high efficiency in transferring energy to the ground.

In particular, a critical spot relates to the heel, where it is in fact necessary to ensure pronation stability, which is particularly important in the sports field.

Although the solutions so far provided and commercially available ensure differentiation in rigidity in specific regions of the sole and particularly of the heel, they must deal with their common limit, which is that it is not possible to vary flexibility according to variable external parameters, such as for example the athlete's weight and build, the type of sport, ground conditions, weather conditions, training stages, etcetera.

All these parameters are instead extremely important to ensure efficient stability and energy transfer, and shoes adjusted according to given preset values of these parameters can be fully unadapted if said values change.

Therefore, the athlete who wishes to have shoes that are always perfectly adapted for these environmental characteristics and for his own physical and structural characteristics must use several shoes.

SUMMARY OF THE INVENTION

A principal aim of the present invention is to provide a stabilizing support, particularly for controlling pronation in sports shoes, which solves the drawbacks shown above in relation with conventional models, particularly ensuring, in addition to differentiated rigidity, particularly in the heel region, the possibility of varying the flexing condition applied to the sole and to the mid-sole without having to perform substantial structural changes to the shoe.

Accordingly, an object of the present invention is to provide a stabilizing support that is highly reliable, has an action that is constant and effective over time, and can also be highly personalized according to the physical characteristics of the user.

Another object of the present invention is to provide a stabilizing support having a marginal cost with respect to the overall cost of the shoe.

Another object of the present invention is to provide a stabilizing support that can be used by the user without complications or complex adjustments.

Another object of the present invention is to provide a stabilizing support that is constructively simple and can be easily assembled to the shoe.

Another object of the present invention is to provide a stabilizing support that can be produced with conventional technologies.

This aim, these objects, and others that will become apparent hereinafter are achieved by a stabilizing support, particularly for controlling pronation in sports shoes, characterized in that it comprises a first bridge-like component, to be included in the sole of the shoe at the outer and/or inner part of the heel and accommodating at least one second detachable stiffening component, which is adapted to vary the flexing condition of said first component.

BRIEF DESCRIPTION OF THE DRAWINGS

Further characteristics and advantages of the present invention will become apparent from the following detailed description of three embodiments thereof, illustrated only by way of non-limitative example in the accompanying drawings, wherein.

DESCRIPTION OF THE PREFERRED EMBODIMENTS

Figure 1:
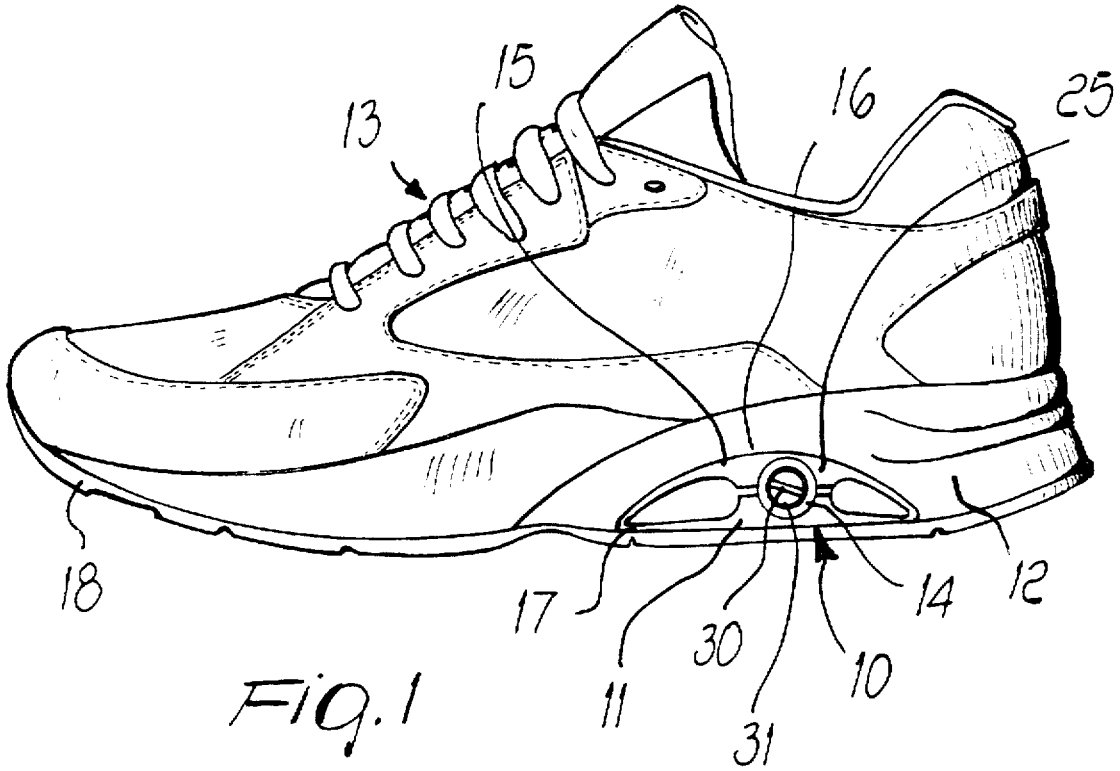
FIG. 1 is a lateral orthographic projection view of a stabilizing support according to the invention, included in a shoe, in a first embodiment.
Figure 2:
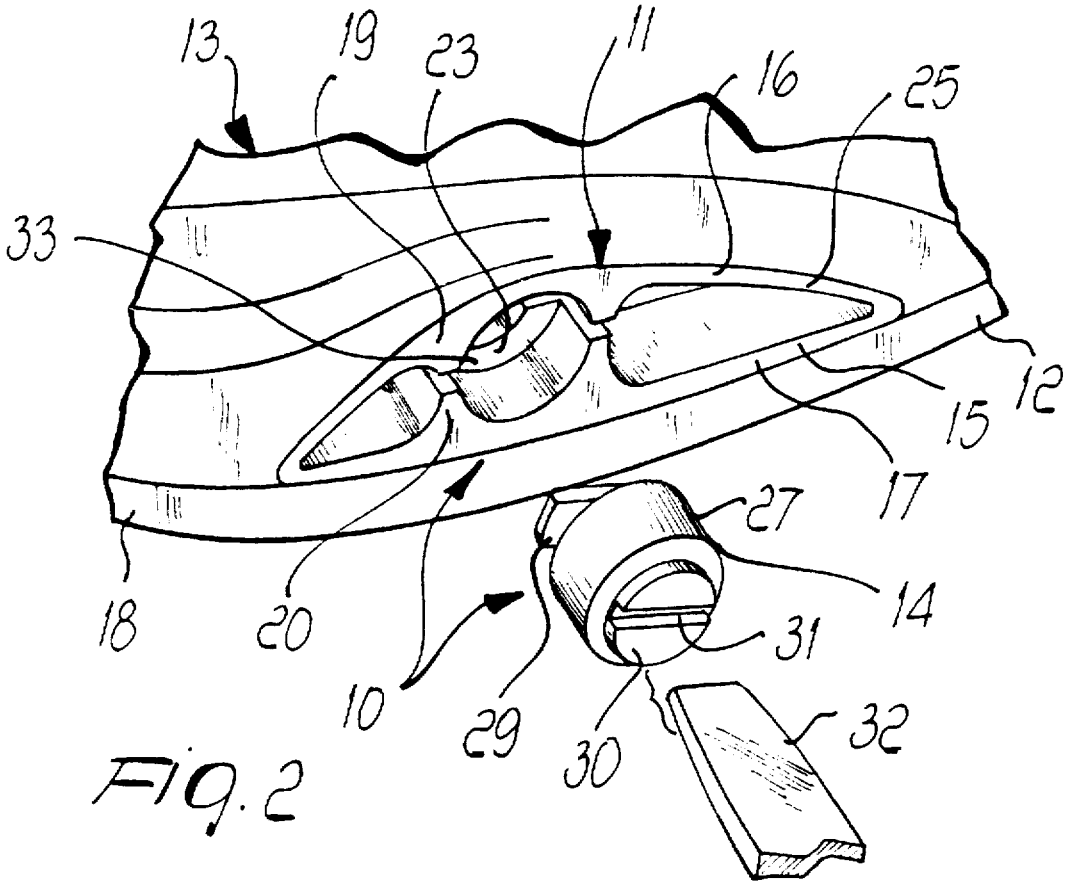
FIG. 2 is an exploded axonometric view of the stabilizing support of FIG. 1.
Figure 3:
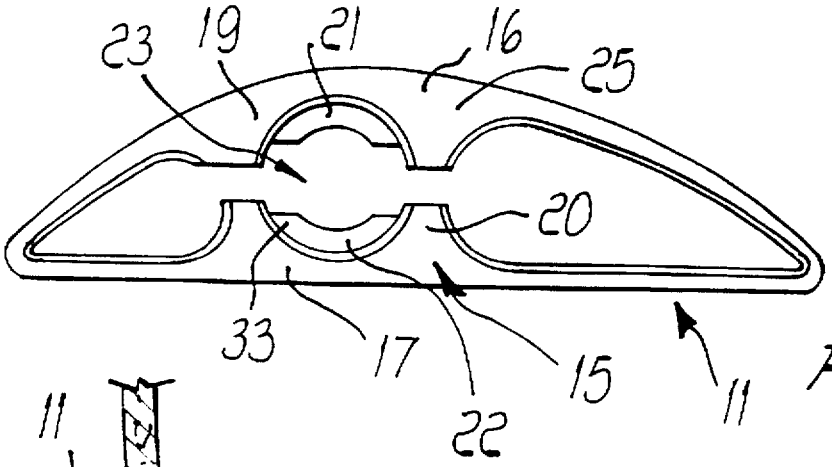
FIG. 3 is an orthographic projection view of a detail of the stabilizing support of FIG. 1.
Figure 4:
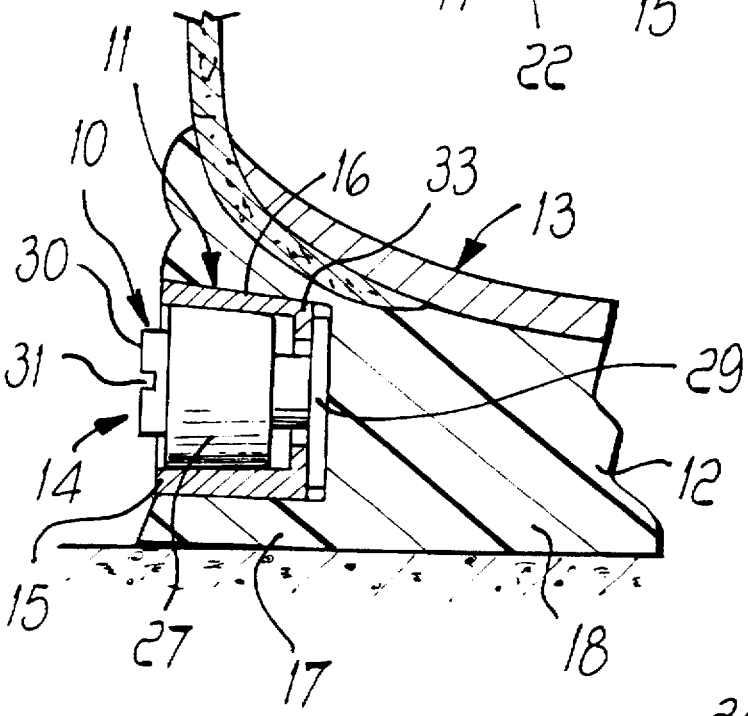
FIG. 4 is a cross-sectional view of the stabilizing support of FIG. 1.
Figure 6:
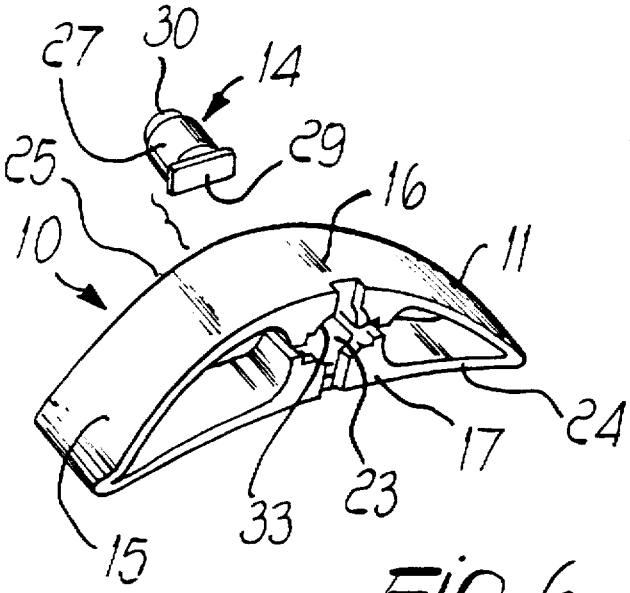
FIGS. 5 and 6 are two exploded axonometric views of the stabilizing support of FIG. 1.
Figure 5:
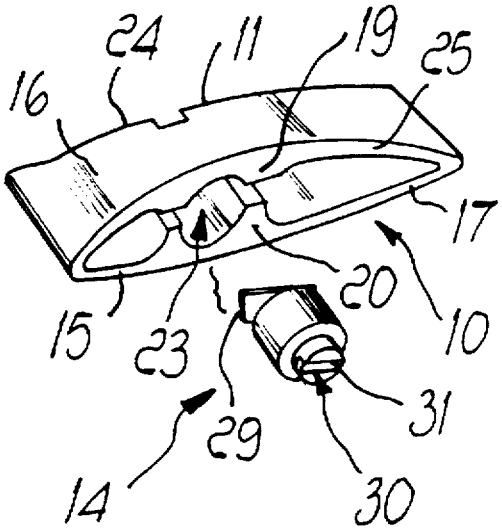
Figure 7:
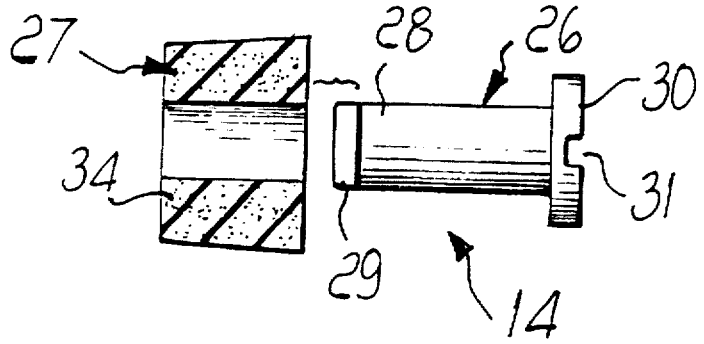
FIG. 7 is a partial sectional view of another detail of the stabilizing support of FIG. 1.

With particular reference to FIGS. 1 to 7, a stabilizing support, particularly for controlling pronation in sports shoes, according to the invention, is generally designated by the reference numeral 10 in a first embodiment.

The stabilizing support 10 comprises a first bridge-like component 11, which in this case is included in a sole 12 of a shoe 13 at the outer part of the heel but may in other cases be included, as an alternative or simultaneously, at the inner part.

Said first component 11 accommodates a removable second stiffening component 14 that is adapted to modify the flexing of said first component 11.

In particular, the first component 11 is constituted by a lens-shaped body 15 made of plastics, which comprises a curved region 16, the convexity whereof is directed upwards on assembly, and a straight region 17, which is directed towards the tread 18 on assembly.

Corresponding shaped raised portions 19 and 20 protrude from the curved region 16 and from the straight region 17 towards the inside of the first component 11; a corresponding cavity 21 and 22 is formed in each one of said raised portions.

Together, the cavities 21 and 22 form a seat 23 for accommodating the second stiffening component 14.

The first component 11 also has an internal or inner lateral surface 24 having a considerable curvature, with its concavity directed towards the inside of the sole 12, and an outer lateral surface 25 having a curvature that matches the curvature of the inner lateral surface 24 but has a greater radius.

The second component 14 comprises a central anchoring part 26 and a peripheral part 27 that is more specifically adapted to vary the flexing of said first component.

The central part 26 is constituted by a pin 28 that has a T-shaped end 29 and another end 30 that is shaped so as to form a diametrical slot 31 adapted to transmit the torque of appropriate auxiliary devices that are generally designated by the reference numeral 32 in the figures.

The T-shaped end 29 engages, with a bayonet-like coupling, at a shaped ridge 33 that protrudes from the surfaces that form the cavities 21 and 22 of the seat 23.

On assembly, the ridge 33 is arranged in the inner part of the sole 12.

The peripheral part 27 is instead constituted by a bush 34, which in this case is molded in place over the pin 28 and is made of a plastic material, such as rubber, polyurethane, or another adapted material.

The bush 34 also has a substantially conical shape.

In practice, the shoe is sold to the customer with a plurality of second components 14 having different rigidities, which allow to provide specific flexings of the heel.

Therefore, the athlete, in addition to having a sole in which rigidity is intrinsically differentiated because of the presence of the stabilizing support 10, can vary, according to the environmental and personal characteristics, the rigidity and therefore the flexing of said stabilizing support 10.

Figure 8:
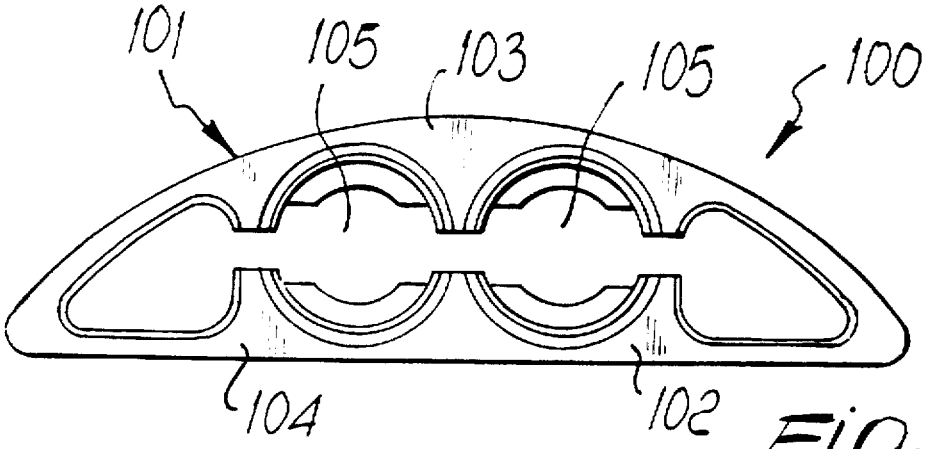
FIG. 8 is a lateral orthographic projection view of a stabilizing support according to the invention, included in a shoe, in a second embodiment.

With particular reference to FIG. 8, a stabilizing support, particularly for controlling pronation in sports shoes, according to the invention, is generally designated by the reference numeral 100 in a second embodiment.

The stabilizing support 100 comprises a first bridge-like component 101 that is included in a sole of a shoe, not shown, at the outer and/or inner part of the heel.

Said first component 101 accommodates two detachable second stiffening components, which are adapted to modify the flexing of said first component 101, are not illustrated, and are identical to the second component 14 of the first embodiment, to the detailed description whereof reference is made.

In particular, the first component 101 is constituted by a lens-shaped body 102, made of plastics, which comprises a curved region 103 the convexity whereof is directed upwards on assembly, and a straight region 104, which is directed towards the tread on assembly.

Both the curved region 103 and the straight region 104 protrude towards the inside of the first component 101 and are shaped so as to form, in a manner that is similar to what has been described for the first embodiment, two seats 105, each adapted to accommodate a corresponding second component.

Figure 9:
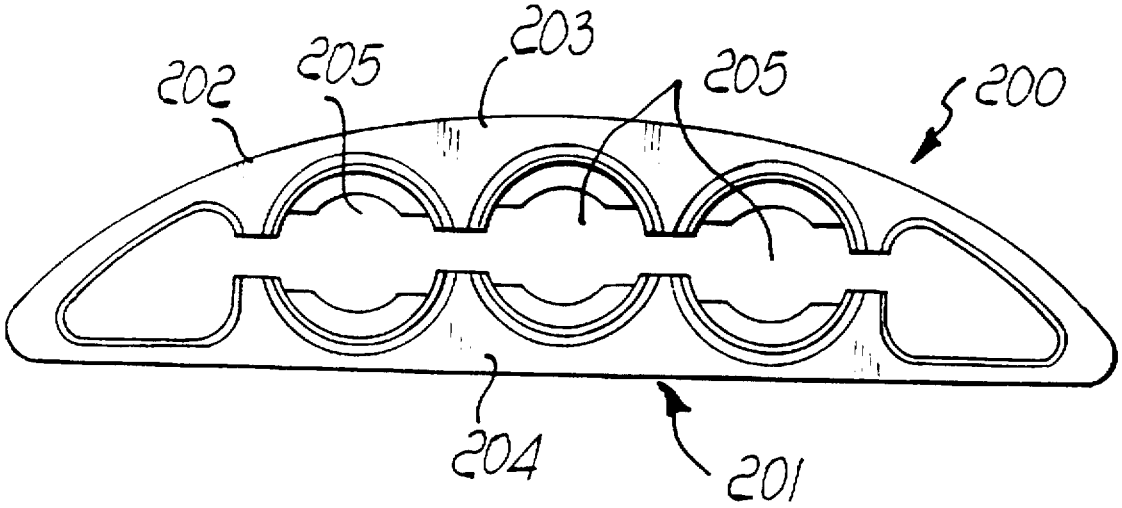
FIG. 9 is a lateral orthographic projection view of a stabilizing support according to the invention, included in a shoe, in a third embodiment.

With particular reference to FIG. 9, a stabilizing support, particularly for controlling pronation in sports shoes, according to the invention, is generally designated by the reference numeral 200 in a third embodiment.

The stabilizing support 200 comprises a first bridge-like component 201, which is included in a sole of a shoe, not shown, at the outer and/or inner part of the heel.

Said first component 201 accommodates three detachable second stiffening components, which are adapted to change the flexing of said first component 201, are not illustrated, and are identical to the second component 14 of the first embodiment, to which reference is made for a more detailed description.

In particular, the first component 201 is constituted by a body 202, which is lens-shaped, is made of plastics, and comprises a curved region 203, the convexity whereof is directed upwards on assembly, and a straight region 204, which is directed towards the tread on assembly.

Both the curved region 203 and the straight region 204 protrude towards the inside of the first component 201 so as to form, like the first embodiment, seats 205, each adapted to accommodate a corresponding second component.

In practice it has been observed that the present invention has achieved the intended aim and objects' and in particular significantly improves the static and dynamic stability level of the shoe as a whole and allows at all times an efficient transfer of the athlete's energy to the ground.

This energy transfer efficiency, as well as said stability, most of all in relation to pronation, are achieved thanks to the possibility of precise and highly flexible adjustment by replacing the second components as described above.

It should also be noted that this adjustment is achieved not only efficiently but with very low costs, since a set of second components does not have particularly high production costs and can also be associated with shoes of less than premium quality.

Nevertheless, the possibility of providing specific and highly personalized flexings is practically unlimited, since it is linked to the rigidity of the material of which the peripheral part of the second component is made.

Moreover, application of the second components to the first component is very easy and quick as well as reliable and safe even in sports in which intense stresses occur.

The present invention is susceptible of numerous modifications and variations, all of which are within the scope of the inventive concept; thus, for example, it is possible to provide a plurality of detachable second stiffening components.

All the details may furthermore be replaced with other technically equivalent elements.

The materials and the dimensions may be any according to requirements.

What is claimed is:

1. A stabilizing support for controlling pronation in a shoe having a sole, said support comprising:

a first flexing component for being lodged in the sole of the shoes said first flexing component comprising at least one seat which extends from a lateral surface of the sole of the shoe inwardly of the sole when said first flexing component is lodged in the sole; and at least one second detachable stiffening component, said second component being detachably accomodatable in said at least one seat of said first flexing component for selectively varying a flexing condition of said first flexing component;

said at least one second detachable stiffening component comprising an inner T-shaped end part, and said at least one seat comprising a pair of inner ridges which Protrude inwardly of said at least one seat and which mutually define an opening between said pair of inner ridges, said inner T-shaped end part and said pair of inner ridges and said opening all being shaped such that in an insertion and removal position of said at least one second detachable stiffening component said T-shaped end is movable through said opening in a direction along an axis of said at least one second detachable stiffening component, and further such that in a blocking position of said at least one second detachable stiffening component in which said at least one second detachable stiffening component is rotated about said axis with respect to said insertion and removal position, said pair of inner ridges engage with said T-shaped end for blocking said at least one second detachable stiffening component from being removed from said at least one seat.

2. Stabilizing support according to claim 1, wherein said first flexing component comprises an elongated hollow body, said body comprising:

an upper curved wall portion, said upper curved wall portion having a convexity which is directed upwardly of the sole when said first flexing component is lodged in the sole; and a lower straight wall portion, said lower straight wall portion being directed downwardly of the sole when said first flexing component is lodged in the sole;

said upper curved wall portion and said lower straight wall portion having mutually connected end portions and said body being hollow between said upper curved wall portion and said lower straight wall portion.

3. Stabilizing support according to claim 2, wherein said body further comprises:

at least two first mutually spaced raised portions protruding inwardly in said body from said upper curved wall portion; and at least two second mutually spaced raised portions protruding inwardly in said body from said lower straight wall portion;

said at least two first mutually spaced raised portions being arranged with respect to said at least two second mutually spaced raised portions such that said at least one seat is delimited by said at least two first mutually spaced raised portions and by said at least two second mutually spaced raised portions.

4. Stabilizing support according to claim 3, wherein said at least one second detachable stiffening component is substantially cylindrical, said at least one seat being substantially shaped complementarily to said at least one second detachable stiffening component.

5. Stabilizing support according to claim 4, wherein said at least one second detachable stiffening component comprises:

a central anchoring part; and a peripheral part surrounding said central anchoring part, said peripheral part being specifically provided with a selected rigidity for selecting the flexing condition of said first flexing component.

6. Stabilizing support according to claim 5, wherein said at least one seat comprises facing surfaces of said first and second raised portions, said first and second raised portions having ends which face each other and which are mutually disconnected so as to form a gap inside said hollow body between respective facing ends of said first and second raised portions.

7. Stabilizing support according to claim 5, wherein said peripheral part is constituted by a slightly conical bush, and wherein said central anchoring part is constituted by a pin, said bush surrounding said pin.

8. Stabilizing support according to claim 7, wherein said bush is made of plastics which is molded in place over said pin.

9. Stabilizing support according to claim 1, wherein said first flexing component is made of plastics.

10. Stabilizing support according to claim 1, wherein said first flexing component has a limited inward extension from the lateral surface of the sole inwardly of the sole when said first flexing component is lodged in the sole such that said limited inward extension of said first flexing component extends only for a limited portion inwardly of the sole.

11. A stabilizing support for controlling pronation in a shoe having a sole, said support comprising:

a first flexing component for being lodged in the sole of the shoe, said first flexing component comprising at least one seat which extends from a lateral surface of the sole of the shoe inwardly of the sole when said first flexing component is lodged in the sole; and at least one second detachable stiffening component, said second component being detachably accomodatable in said at least one seat of said first flexing component for selectively varying a flexing condition of said first flexing component;

said first flexing component comprising an elongated hollow body, said body comprising: an upper wall portion, said upper wall portion being directed upwardly of the sole when said first flexing component is lodged in the sole; and a lower wall portion, said lower wall portion being directed downwardly of the sole when said first flexing component is lodged in the sole; said upper wall portion and said lower wall portion having mutually connected end portions and said body being hollow between said upper wall portion and said lower wall portion;

said body further comprising: at least two first mutually spaced raised portions protruding inwardly in said body from said upper curved wall portion; and at least two second mutually spaced raised portions protruding inwardly in said body from said lower straight wall portion; said at least two first mutually spaced raised portions being arranged with respect to said at least two second mutually spaced raised portions such that said at least one seat is delimited by said at least two first mutually spaced raised portions and by said at least two second mutually spaced raised portions;

said at least one seat comprising facing surfaces of said first and second raised portions, said first and second raised portions having ends which face each other and which are mutually disconnected so as to form a gap inside said hollow body between respective facing ends of said first and second raised portions.

12. Stabilizing support according to claim 11, wherein said upper wall portion is curved with a convexity which is directed upwardly of the sole when said first flexing component is lodged in the sole, and wherein said lower wall portion is substantially straight.

13. Stabilizing support according to claim 11, wherein said at least one second detachable stiffening component is substantially cylindrical, said at least one seat being substantially shaped complementarily to said at least one second detachable stiffening component.

14. Stabilizing support according to claim 13, wherein said at least one second detachable stiffening component comprises:

a central anchoring part; and a peripheral part surrounding said central anchoring part, said peripheral part being specifically provided with a selected rigidity for selecting the flexing condition of said first flexing component.

15. Stabilizing support according to claim 14, wherein said peripheral part is constituted by a bush, and wherein said central anchoring part is constituted by a pin, said bush surrounding said pin.

16. Stabilizing support according to claim 15, wherein said pin has an inner T-shaped end part, and said at least one seat comprises a pair of inner ridges which protrude inwardly of said at least one seat and which mutually define an opening between said pair of inner ridges, said inner T-shaped end part and said pair of inner ridges and said opening all being shaped such that in an insertion and removal position of said at least one second detachable stiffening component said T-shaped end is movable through said opening in a direction along an axis of said at least one second detachable stiffening component, and further such that in a blocking position of said at least one second detachable stiffening component in which said at least one second detachable stiffening component is rotated about said axis with respect to said insertion and removal position, said pair of inner ridges engage with said T-shaped end for blocking said at least one second detachable stiffening component from being removed from said at least one seat.

17. Stabilizing support according to claim 16, wherein said bush is made of plastics which is molded in place over said pin.

18. Stabilizing support according to claim 17, wherein said bush is conically shaped.

19. Stabilizing support according to claim 11, wherein said first flexing component is made of plastics.

20. Stabilizing support according to claim 11, wherein said first flexing component has a limited inward extension from the lateral surface of the sole inwardly of the sole when said first flexing component is lodged in the sole such that said limited inward extension of said first flexing component extends only for a limited portion inwardly of the sole.

* * * * *

UNITED STATES PATENT AND TRADEMARK OFFICE

CERTIFICATE OF CORRECTION

PATENT NO. : 5,778,560
DATED : July 14, 1998
INVENTOR(S) : Daniell, D.

It is certified that error appears in the above-identified patent and that said Letters Patent is hereby corrected as shown below:

Title page, item [54], and col. 1, lines 1-3, the Title should read--

STABILIZING SUPPORT, PARTICULARLY FOR CONTROLLING--PRONATION IN SPORTS SHOES.

Signed and Sealed this

Twenty-ninth Day of September, 1998

*Attest:*

*Attesting Officer*

Bruce Lehman

BRUCE LEHMAN

*Commissioner of Patents and Trademarks*